US009417557B2

(12) United States Patent
Itabashi

(10) Patent No.: US 9,417,557 B2
(45) Date of Patent: Aug. 16, 2016

(54) DEVELOPING CARTRIDGE INCLUDING HOUSING HAVING OPENING FOR FILLING HOUSING WITH DEVELOPER

(71) Applicant: Brother Kogyo Kabushiki Kaisha, Nagoya-shi, Aichi-ken (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/834,903

(22) Filed: Aug. 25, 2015

(65) Prior Publication Data

US 2016/0054679 A1 Feb. 25, 2016

(30) Foreign Application Priority Data

Aug. 25, 2014 (JP) ..... 2014-170209

(51) Int. Cl.
*G03G 15/06* (2006.01)
*G03G 15/08* (2006.01)
*G03G 21/16* (2006.01)

(52) U.S. Cl.
CPC ..... *G03G 15/0865* (2013.01); *G03G 21/1647* (2013.01)

(58) Field of Classification Search
CPC ..... G03G 21/1647; G03G 15/0865
See application file for complete search history.

(56) References Cited

U.S. PATENT DOCUMENTS 5,729,795 A * 3/1998 Kavolius ..... G03G 15/0894 399/109
5,899,602 A 5/1999 Noda et al.
2006/0171737 A1* 8/2006 Nishimura ..... G03G 15/0894 399/109
2006/0171738 A1* 8/2006 Mori ..... G03G 21/181 399/111
2006/0171744 A1* 8/2006 Ikeda ..... G03G 15/0875 399/262
2007/0147887 A1* 6/2007 Hattori ..... G03G 21/1623 399/119
2008/0199224 A1* 8/2008 Isomura ..... G03G 15/0875 399/258
2009/0245857 A1* 10/2009 Tanabe ..... G03G 21/181 399/109
2011/0293320 A1* 12/2011 Kato ..... G03G 15/0896 399/106
2012/0051795 A1* 3/2012 Mushika ..... G03G 15/0863 399/262
2013/0170845 A1* 7/2013 Itabashi ..... G03G 15/757 399/12
2013/0287425 A1* 10/2013 Takagi ..... G03G 15/0806 399/90
2014/0086640 A1* 3/2014 Okabe ..... G03G 15/0875 399/263
2015/0003868 A1* 1/2015 Shimizu ..... G03G 15/0896 399/119
2015/0117904 A1* 4/2015 Mori ..... G03G 15/0891 399/254

FOREIGN PATENT DOCUMENTS

JP H08-305246 A 11/1996
JP 10149004 A * 6/1998
JP 2000338760 A * 12/2000
JP 2006184515 A * 7/2006
WO WO 2014080538 A1 * 5/2014 ..... G03G 15/0896

OTHER PUBLICATIONS

Machine translation of JP 2000338760.*

* cited by examiner

*Primary Examiner* — David Bolduc
(74) *Attorney, Agent, or Firm* — Banner & Witcoff, Ltd.

(57) ABSTRACT

A developing cartridge including: a housing; a developing roller rotatable around a rotation axis extending in a first direction; a developing gear supported by an end portion of the developing roller; and a driving force receiving member rotatable around a rotation axis extending in the first direction by receiving a driving force from an image forming apparatus body and including a gear portion engaging with the developing gear, wherein the housing has an opening for filling the housing with developer, and wherein at least a part of the driving force receiving member overlaps the opening when viewed in the first direction.

16 Claims, 10 Drawing Sheets

DEVELOPING CARTRIDGE INCLUDING HOUSING HAVING OPENING FOR FILLING HOUSING WITH DEVELOPER

CROSS-REFERENCE TO RELATED APPLICATIONS

This application claims priority from Japanese Patent Application No. 2014-170209 filed on Aug. 25, 2014, the entire contents of which are incorporated herein by reference.

TECHNICAL FIELD

Aspects of the present invention relates to a developing cartridge which is attached to an image forming apparatus employing an electrophotographic system.

BACKGROUND

In related art, a process cartridge which is attached to an image forming apparatus employing an electrophotographic system has been known. The process cartridge is attached to the image forming apparatus in a state where an inside thereof is filled with toner.

As such a process cartridge, a process cartridge including a cartridge frame in which a toner developing frame and a cleaning frame are coupled is known. This process cartridge includes developing means, such as a photosensitive drum and a developing roller, in the cartridge frame. In the cartridge frame, the toner developing frame includes a toner containing section and a toner filling port. In the process cartridge, the toner containing section is filled with toner through the toner filling port. The process cartridge in this state is attached to the image forming apparatus. When an image forming operation is started, the toner in the toner containing section is supplied to the developing roller through a toner supply opening and the toner moves from the developing roller to the photosensitive drum.

In the above-described process cartridge, the toner containing section is filled with toner in a state where the toner supply opening is sealed with a toner sealing member. Accordingly, in an unused process cartridge, there is a possibility that only the toner containing section is filled with toner and toner is not uniformly provided to the vicinity of the developing roller.

When such an unused process cartridge is attached to an image forming apparatus, a certain time is required until the developing roller carries the toner after the image forming operation is started. As a result, image formation failure may occur just after the image forming operation is started.

SUMMARY

Therefore, an object of an aspect of the invention is to provide a developing cartridge which can smoothly form an image even just after an unused developing cartridge is attached to an image forming apparatus.

According to an aspect of the invention, there is provided a developing cartridge including: a housing; a developing roller rotatable around a rotation axis extending in a first direction; a developing gear supported by an end portion of the developing roller; and a driving force receiving member rotatable around a rotation axis extending in the first direction by receiving a driving force from an image forming apparatus body and including a gear portion engaging with the developing gear, wherein the housing has an opening for filling the housing with developer, and wherein at least a part of the driving force receiving member overlaps the opening when viewed in the first direction.

According to another aspect of the invention, there is provided a developing cartridge including: a housing configured to contain developer therein and including a first side wall and a second side wall which are located with a gap therebetween; a developing roller located between the first side wall and the second side wall and configured to rotate around a rotation axis extending in a first direction; a supply roller located between the first side wall and the second side wall and configured to supply developer to the developing roller by rotating around a rotation axis extending in the first direction; and a driving force receiving member located on an opposite side of the second side wall with respect to the first side wall, configured to rotate around a rotation axis extending in the first direction, and configured to rotate the developing roller and the supply roller by receiving a driving force from an image forming apparatus body, wherein the first side wall has an opening for filling the housing with developer, and wherein, when viewed in the first direction, at least a part of the opening is located at the developing roller side than a tangent line passing through one edge point among two edge points of the driving force receiving member, the two edge points being edge points at which straight lines, which are parallel to a straight line orthogonal to both the rotation axis of the supply roller and the rotation axis of the driving force receiving member, respectively serve as tangent lines of the driving force receiving member, and the one edge point being located farthest from the developing roller among the two edge points.

According to another aspect of the invention, there is provided a developing cartridge including: a housing including, a first side wall and a second side wall which are located with a gap therebetween, a developer containing chamber configured to contain developer therein, and a development chamber communicating with the developer containing chamber and accommodating therein a developing roller which is configured to rotate around a rotation axis extending in a first direction in which the first side wall and the second side wall face each other; and a driving force receiving member located on an opposite side of the second side wall with respect to the first side wall, configured to rotate around a rotation axis extending in the first direction, and configured to rotate the developing roller by receiving a driving force from an image forming apparatus body, wherein the first side wall has an opening for filling the housing with developer, and wherein at least a part of the opening is located at the developing roller side than a straight line extending along a third direction and passing through one edge point among two edge points of the driving force receiving member, the developer containing chamber and the development chamber being arranged in a second direction, the two edge points being edge points of the driving force receiving member in the second direction when the driving force receiving member is projected in the third direction perpendicular to both the first direction and the second direction, and the one edge point being located farthest from the developing roller among the two edge points.

DETAILED DESCRIPTION

1. Summary of Developing Cartridge

Figure 1:
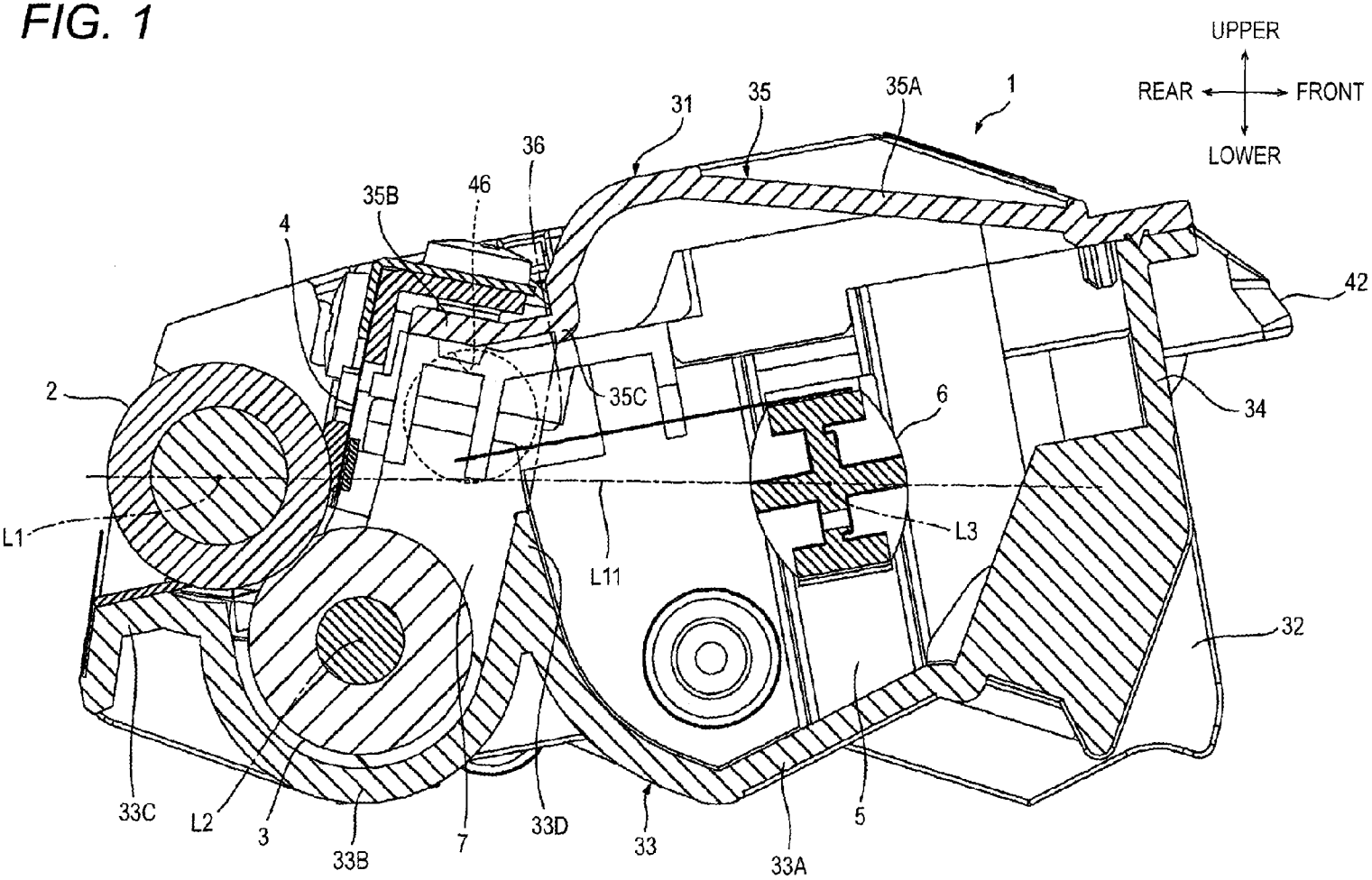
FIG. 1 is a cross-sectional view illustrating an embodiment of a developing cartridge according to the invention.

As illustrated in FIG. 1, a developing cartridge 1 includes a developing roller 2, a supply roller 3, a thickness regulating blade 4, and an agitator 6. As will be described later, the inside of the developing cartridge 1 is partitioned into a toner containing chamber 5 serving as an example of the developer containing chamber and a development chamber 7.

In the following description, directions of the developing cartridge 1 are mentioned based on a state where the developing cartridge 1 is horizontally placed. Specifically, the directions are based on arrows in FIG. 1. That is, the upper side in FIG. 1 is defined as an upper side and the lower side in FIG. 1 is defined as a lower side. The right side in FIG. 1 is defined as a front side and the left side in FIG. 1 is defined as a rear side. The right-left direction is based on a state where the developing cartridge 1 is viewed from the front side. That is, the front side of FIG. 1 is defined as a left side and the rear side in FIG. 1 is defined as a right side. The right-left direction is an example of the first direction, the front-rear direction is an example of the second direction, and the upper-lower direction is an example of the third direction.

The developing roller 2 is rotatably supported by a rear end portion of the developing cartridge 1. The developing roller 2 has a substantially cylindrical shape extending in the right-left direction. Specifically, the developing roller 2 can rotate around a rotation axis L1 extending in the right-left direction.

The supply roller 3 is rotatably supported by the developing cartridge 1 on the lower-front side of the developing roller 2. The supply roller 3 has a substantially cylindrical shape extending in the right-left direction. Specifically, the supply roller 3 can rotate around a rotation axis L2 extending in the right-left direction. The supply roller 3 is in contact with the lower-front end portion of the developing roller 2.

The thickness regulating blade 4 is located on the upper-front side of the developing roller 2. The thickness regulating blade 4 is in contact with the front end portion of the developing roller 2.

The agitator 6 is located on the front side of the developing roller 2 and the supply roller 3 with a gap therebetween. The agitator 6 is rotatably supported by the central portion of the developing cartridge 1 and extends in the right-left direction. Specifically, the agitator 6 can rotate around a rotation axis L3 extending in the right-left direction.

The toner containing chamber 5 is located on the front side of the supply roller 3 and the thickness regulating blade 4. The toner containing chamber 5 is configured to contain therein toner serving as an example of the developer. The agitator 6 is located in the toner containing chamber 5. The development chamber 7 is located on the rear side of the toner containing chamber 5.

2. Use Mode of Developing Cartridge

Figure 2:
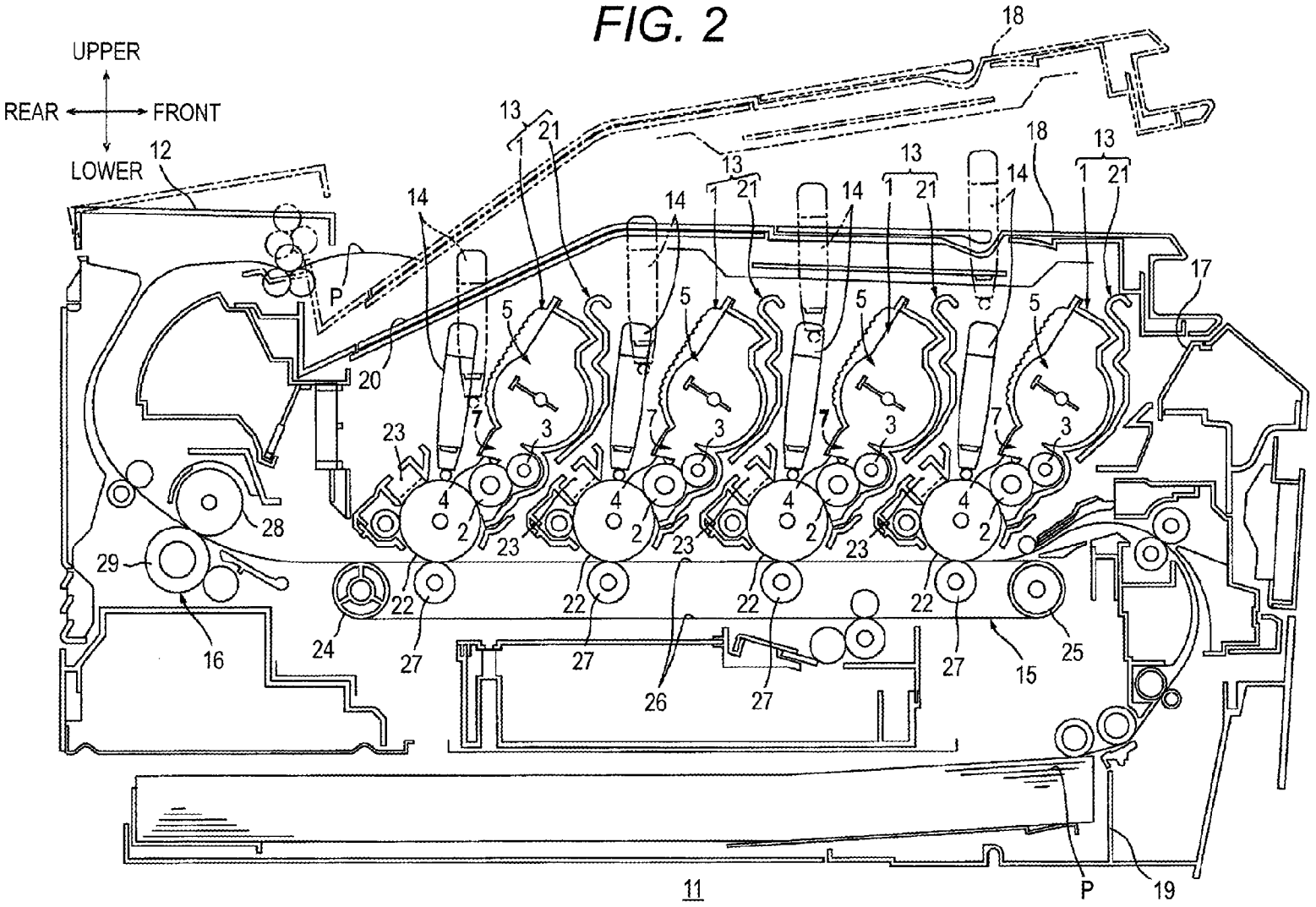
FIG. 2 is a cross-sectional view illustrating a central part of a printer including the developing cartridge illustrated in FIG. 1.

As illustrated in FIG. 2, a printer 11 is a direct tandem type color printer which is placed horizontally.

In the following description, the upper-lower direction of the printer 11 is mentioned based on a state where the printer 11 is horizontally placed. Specifically, the upper-lower direction is based on the arrows illustrated in FIG. 2. That is, the upper side in FIG. 2 is defined as an upper side and the lower side in FIG. 2 is defined as a lower side. The right side in FIG. 2 is defined as a front side and the left side in FIG. 2 is defined as a rear side. The right-left direction of the printer 11 is based on a state where the printer 11 is viewed from the front side. That is, the front side in FIG. 2 is defined as a left side and the rear side in FIG. 2 is defined as a right side.

The printer 11 includes a body casing 12, a plurality of process cartridges 13, a plurality of LED units 14, a transfer unit 15, and a fixing unit 16.

The body casing 12 has a substantially box shape. The body casing 12 includes an opening 17, a top cover 18, and a sheet feeding tray 19.

The opening 17 is located at the top end portion of the body casing 12. The opening 17 allows the inside and the outside of the body casing 12 to communicate with each other in the vertical direction so as to allow the process cartridges 13 to pass therethrough.

The top cover 18 is located at the top end portion of the body casing 12. The top cover 18 has a substantially plate shape extending in the front-rear direction. The rear end portion of the top cover 18 is swingably supported by a back wall of the body casing 12. The top cover 18 opens and closes the opening 17 by vertically swinging with the rear end portion thereof as a fulcrum as indicated by a virtual line. The top cover 18 includes a sheet discharging tray 20.

The sheet discharging tray 20 is located substantially at the center in the front-rear direction of the top cover 18. The sheet discharging tray 20 is depressed downward from the top surface of the top cover 18 so as to place a sheet P thereon.

The sheet feeding tray 19 is located at the bottom of the body casing 12. The sheet feeding tray 19 is configured to place a sheet P thereon.

The plurality of process cartridges 13 correspond to yellow, magenta, cyan, and black, respectively, and are arranged in parallel to each other with a gap therebetween in the front-rear direction in the body casing 12. The respective process cartridges 13 can be attached to or detached from the body casing 12 through the opening 17. Each of the process cartridges 13 includes a drum cartridge 21 and the above-mentioned developing cartridge 1.

The drum cartridge 21 includes a photosensitive drum 22 and a scorotron charger 23.

The photosensitive drum 22 has a substantially cylindrical shape extending in the right-left direction. The photosensitive drum 22 is rotatably supported by the lower-rear end portion of the drum cartridge 21.

The scorotron charger 23 is located to face the upper-rear side of the photosensitive drum 22 with a gap therebetween.

The developing cartridge 1 is attached to the drum cartridge 21 such that the rear end portion thereof faces the lower-rear side on the upper-front side of the photosensitive drum 22. The developing roller 2 of the developing cartridge 1 is in contact with the upper-front end portion of the photosensitive drum 22. The developing cartridge 1 is attached to or detached from the drum cartridge 21.

The respective LED units 14 are supported by the top cover 18 so as to be located above the photosensitive drums 22 of the corresponding processes cartridges 13.

The transfer unit 15 is located below the process cartridges 13. The transfer unit 15 includes a driving roller 24, a driven roller 25, a transport belt 26, and a plurality of transfer rollers 27.

The driving roller 24 is rotatably supported by the rear end portion of the transfer unit 15.

The driven roller 25 is rotatably supported by the front end portion of the transfer unit 15.

The transport belt 26 is suspended on the driving roller 24 and the driven roller 25. The upper part of the transport belt 26 is in contact with the lower end portions of the photosensitive drums 22. The transport belt 26 circumferentially moves such that the upper part thereof moves from the front side to the rear side by driving of the driving roller 24 and the driven roller 25 being driven.

The transfer rollers 27 are located below the photosensitive drums 22, respectively. The transfer rollers 27 are in contact with the bottom surface of the upper part of the transport belt 26.

The fixing unit 16 is located on the rear side of the transfer unit 15. The fixing unit 16 includes a heating roller 28 and a pressure roller 29 in contact with the lower-rear end portion of the heating roller 28.

When the printer 11 starts an image forming operation, the scorotron chargers 23 uniformly charge the surfaces of the photosensitive drums 22. Thereafter, the LED units 14 expose the surfaces of the photosensitive drums 22. Accordingly, an electrostatic latent image based on image data is formed on the surfaces of the photosensitive drums 22.

The agitator 6 agitates toner in the toner containing chamber 5 and carries the toner to the development chamber 7. The supply roller 3 supplies the toner in the development chamber 7 to the developing roller 2. At this time, the toner is frictionally charged to a positive polarity between the developing roller 2 and the supply roller 3 and is carried on the developing roller 2.

The developing roller 2 supplies the carried toner to the electrostatic latent image on the surface of the corresponding photosensitive drum 22. Accordingly, a toner image is carried on the surface of the photosensitive drum 22.

A sheet P is transported to the upper-front side from the sheet feeding tray 19 is U-turned to the upper-rear side, and is fed between the foremost photosensitive drum 22 and the transport belt 26 at a predetermined timing one by one, by rotations of various rollers. Thereafter, the sheet P is transported from front to rear by the transport belt 26. The toner images on the photosensitive drums 22 are transferred onto the sheet P when the sheet P passes between the photosensitive drums 22 and the transfer rollers 27.

Thereafter, the sheet P is heated and pressurized when the sheet P passes between the heating roller 28 and the pressure roller 29. At this time, the toner image on the sheet P is thermally fixed to the sheet P. Thereafter, the sheet P is discharged to the sheet discharging tray 20.

3. Details of Developing Cartridge

Figure 3:
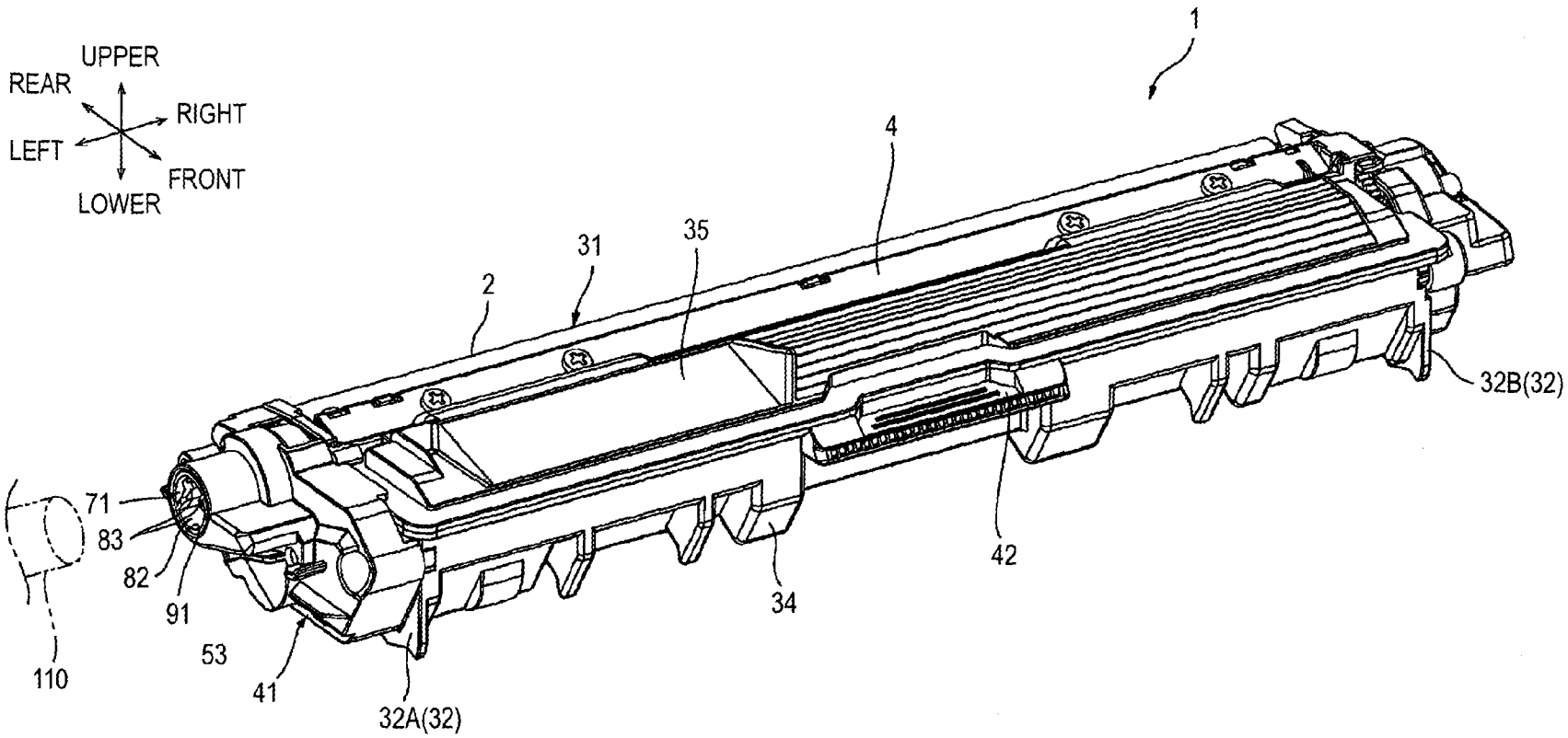
FIG. 3 is a perspective view illustrating the developing cartridge illustrated in FIG. 1 when viewed from the upper-left side.

As illustrated in FIGS. 1 and 3, the developing cartridge 1 includes a developing frame 31 serving as an example of the housing and a drive unit 41.

(1) Developing Frame

The developing frame 31 has a substantially rectangular tubular shape which extends in the right-left direction and of which the rear end portion is opened. The developing frame 31 includes a pair of side walls 32, a bottom wall 33, a front wall 34, and a top wall 35.

The side walls 32 are respectively located at both end portions in the right-left direction of the developing frame 31. Each of the side walls 32 has a substantially rectangular plate shape when viewed from the side surface extending in the front-rear direction. The side walls 32 respectively rotatably support both end portions in the right-left direction of the developing roller 2, both end portions in the right-left direction of the supply roller 3, and both end portions in the right-left direction of the agitator 6 at the rear end portions thereof. Among the side walls 32, the side wall located on the left side is a left side wall 32A serving as an example of the first side wall and the side wall located on the right side is a right side wall 32B serving as an example of the second side wall.

The bottom wall 33 is located at the lower end portion of the developing frame 31. Both end portions in the right-left direction of the bottom wall 33 are connected to the lower end portions of the side walls 32. The bottom wall 33 includes a first bottom wall portion 33A, a second bottom wall portion 33B, and a third bottom wall portion 33C.

The first bottom wall portion 33A is located in a front half portion of the bottom wall 33. The first bottom wall portion 33A has a substantially V shape in a cross-sectional view of which substantially the center in the front-rear direction is concave downward.

The second bottom wall portion 33B is located on the rear side of the first bottom wall portion 33A. The second bottom wall portion 33B has a substantially arc shape in a cross-sectional view. The second bottom wall portion 33B is connected to the rear end portion of the first bottom wall portion 33A and extends rearward so as to be curved along the outer circumferential surface of the supply roller 3.

The junction of the first bottom wall portion 33A and the second bottom wall portion 33B is a protruding portion 33D. The protruding portion 33D has a substantially triangular shape in a cross-sectional view having a vertex on the upper side. The vertex of the protruding portion 33D is located at the center in the upper-lower direction and at the center in the front-rear direction in the developing cartridge 1.

The third bottom wall portion 33C is located on the rear side of the second bottom wall portion 33B. The third bottom wall portion 33C has a substantially L shape in a cross-sectional view. The third bottom wall portion 33C is connected to the rear end portion of the second bottom wall portion 33B, extends rearward on the lower side of the developing roller 2, and then extends downward.

The front wall 34 is located at the front end portion of the developing frame 31. The front wall 34 has a substantially plate shape connected to the front end portion of the bottom wall 33 and extending upwardly. Both end portions in the right-left direction of the front wall 34 are respectively connected to the front end portions of the pair of side walls 32. The front wall 34 includes a grip 42.

The grip 42 has a substantially plate shape protruding forward from the center in the right-left direction of the top end portion of the front wall 34 and extending in the right-left direction.

The top wall 35 is located at the upper end portion of the developing frame 31. The top wall 35 has a substantially plate shape extending in the right-left direction. The front end portion of the top wall 35 is connected to the upper end portion of the front wall 34. Both end portions in the right-left direction of the top wall 35 are respectively connected to the upper end portions of the pair of side walls 32. The top wall 35 includes a first top wall portion 35A and a second top wall portion 35B.

The first top wall portion 35A is located in the central portion of the top wall 35 and in a front half portion thereof. The first top wall portion 35A extends rearward from the front side, is curved such that the upper-rear portion thereof swells, and extends rearward.

The second top wall portion 35B is connected to the rear end portion of the first top wall portion 35A and extends rearward. The second top wall portion 35B supports the thickness regulating blade 4.

The junction of the first top wall portion 35A and the second top wall portion 35B is a junction 35C. The junction 35C is located on the upper part and in the central portion in the front-rear direction in the developing cartridge 1.

The space between the protruding portion 33D and the junction 35C is a communication port 36. In the developing cartridge 1, the front part of the communication port 36 is defined as the toner containing chamber 5 and the rear part of the communication port 36 is defined as the development chamber 7. That is, the toner containing chamber 5 and the development chamber 7 communicate with each other via the communication port 36 and are arranged in the front-rear direction. In the developing cartridge 1, the developing roller 2 and the agitator 6 are arranged in the front-rear direction and, specifically, a straight line L11 connecting the rotation axis L1 of the developing roller 2 and the rotation axis L3 of the agitator 6 extends along the front-rear direction.

(2) Configuration of Driving Unit (2-1) Left Side Wall

Figure 4:
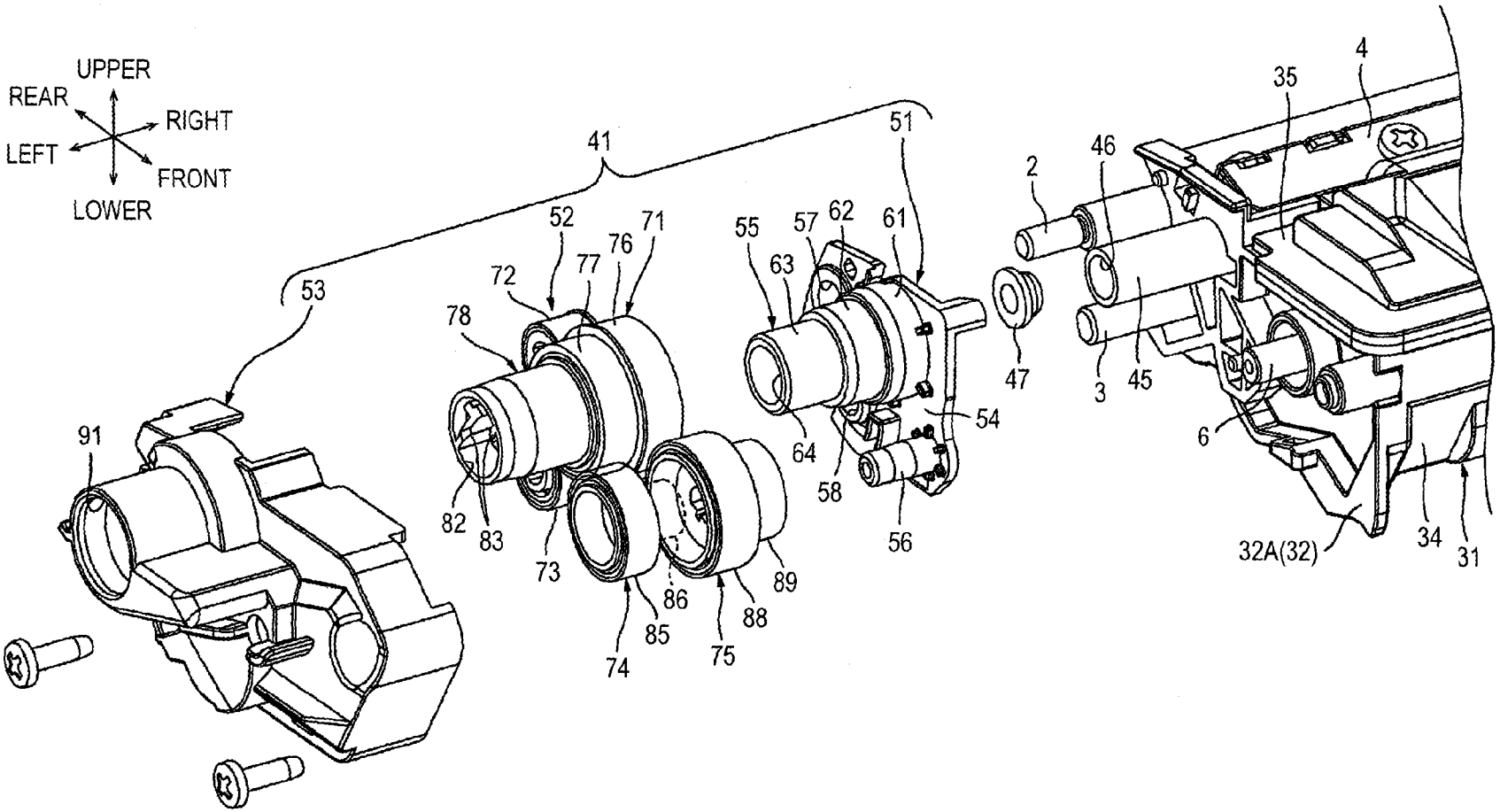
FIG. 4 is an exploded perspective view illustrating a left end portion of the developing cartridge illustrated in FIG. 1 when viewed from the upper-left side.

As illustrated in FIG. 4, the left end portion of the developing roller 2, the left end portion of the supply roller 3, and the left end portion of the agitator 6 protrude leftward from the left side wall 32A of the developing cartridge 1. The left side wall 32A includes a filling tube 45.

The filling tube 45 is located at the rear end portion of the left side wall 32A and is located on the front side of the left end portion of the developing roller 2 and the left end portion of the supply roller 3 exposed from the left side wall 32A. The filling tube 45 has a substantially cylindrical shape extending in the right-left direction and protrudes outward in the right-left direction from both surfaces of the left side wall 32A. The opening portion in the filling tube 45 is a filling port 46 serving as an example of the opening.

The filling port 46 has a substantially cylindrical shape in a side view and penetrates the filling tube 45 in the right-left direction. That is, the filling port 46 penetrates the left side wall 32A in the right-left direction and communicates with the development chamber 7 of the developing cartridge 1. As illustrated in FIG. 5B, the left end portion of the filling port 46 is closed by a cap 47 serving as an example of the closing member.

(2-2) Driving Unit

As illustrated in FIGS. 3 and 4, the driving unit 41 is located on the left side of the left side wall 32A and includes a support shaft unit 51, a gear train 52, and a gear cover 53.

(2-2-1) Support Shaft Unit

As illustrated in FIGS. 4 and 5B, the support shaft unit 51 is attached to the rear portion of the left surface of the left side wall 32A. The support shaft unit 51 includes a base 54, a coupling support shaft 55 serving as an example of the support shaft, and an idle gear support shaft 56.

The base 54 has a substantially rectangular plate shape in a side view and covers the rear portion of the left surface of the left side wall 32A. The base 54 includes a first insertion hole 57 and a second insertion hole 58.

The first insertion hole 57 has a substantially circular shape in a side view and penetrates the upper-rear portion of the base 54 in the right-left direction. The diameter of the first insertion hole 57 is larger than the diameter of the left end portion of the developing roller 2.

The second insertion hole 58 has a substantially circular shape in a side view and penetrates the lower portion at the center in the front-rear direction of the base 54 in the right-left direction. The diameter of the second insertion hole 58 is larger than the diameter of the left end portion of the supply roller 3.

The coupling support shaft 55 has a substantially cylindrical shape extending from the upper portion to the left side at the center in the right-left direction of the base 54. The coupling support shaft 55 includes a first shaft portion 61, a second shaft portion 62, and a third shaft portion 63. The coupling support shaft 55 is located on the left side of the left side wall 32A, that is, on the opposite side of the right side wall 32B with respect to the left side wall 32A (see FIG. 3).

The first shaft portion 61 has a substantially cylindrical shape extending in the right-left direction and the right end portion thereof is connected to the left surface of the upper portion of the base 54 at the center in the right-left direction.

The second shaft portion 62 has a substantially cylindrical shape extending from the left end portion of the first shaft portion 61 to the left side. The outer diameter of the second shaft portion 62 is smaller than the outer diameter of the first shaft portion 61 and the inner diameter of the second shaft portion 62 is smaller than the inner diameter of the first shaft portion 61.

The third shaft portion 63 has a substantially cylindrical shape extending from the left end portion of the second shaft portion 62 to the left side. The outer diameter of the third shaft portion 63 is smaller than the outer diameter of the second shaft portion 62 and the inner diameter of the third shaft portion 63 is smaller than the inner diameter of the second shaft portion 62 and slightly larger than the outer diameter of the filling tube 45.

An opening in the coupling support shaft 55 is a penetration hole 64. That is, the penetration hole 64 penetrates the inside of the first shaft portion 61, the inside of the second shaft portion 62, and the inside of the third shaft portion 63.

The idle gear support shaft 56 has a substantially cylindrical shape extending from the lower-front portion of the base 54 to the left side.

The support shaft unit 51 is attached to the rear portion of the left surface of the left side wall 32A by inserting the filling tube 45 into the penetration hole 64 of the coupling support shaft 55, inserting the left end portion of the developing roller 2 into the first insertion hole 57, and inserting the supply roller 3 into the second insertion hole 58. As illustrated in FIG. 5B, the left end portion of the filling tube 45 comes in contact with the inner circumferential surface on the right side of the third shaft portion 63 of the support shaft unit 51.

(2-2-2) Gear Train

Figure 5A:
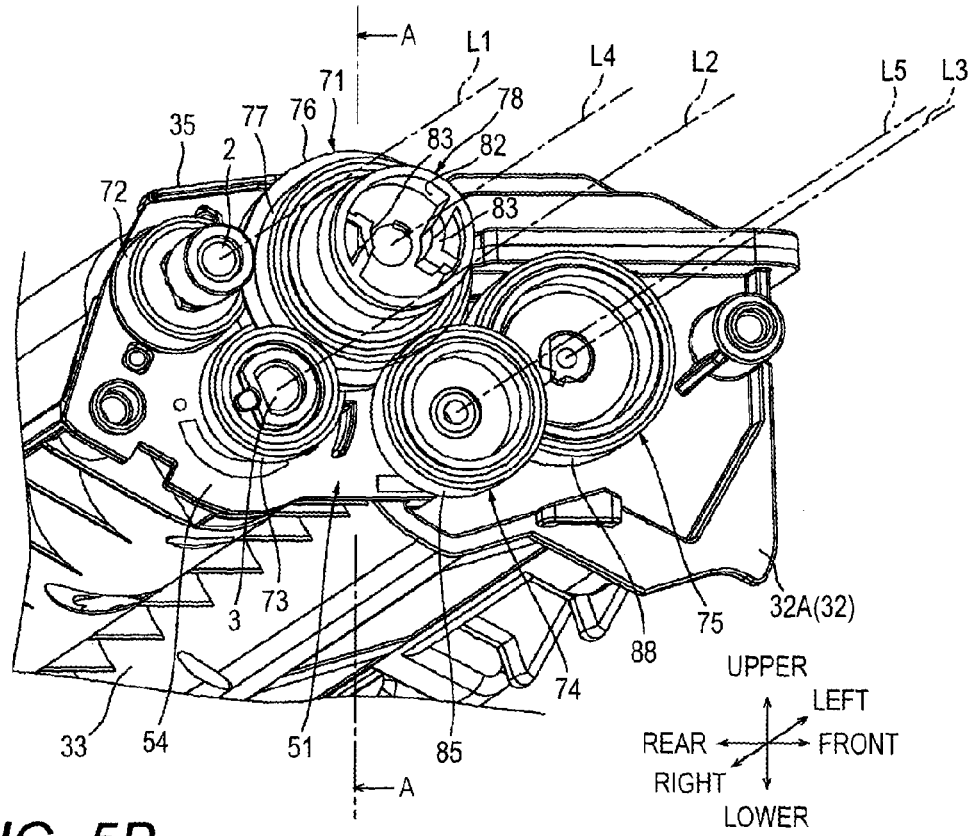
FIG. 5A is a perspective view illustrating the left end portion of the developing cartridge illustrated in FIG. 1 when viewed from the lower-left side and illustrating a state where a gear cover is detached therefrom.
Figure 5B:
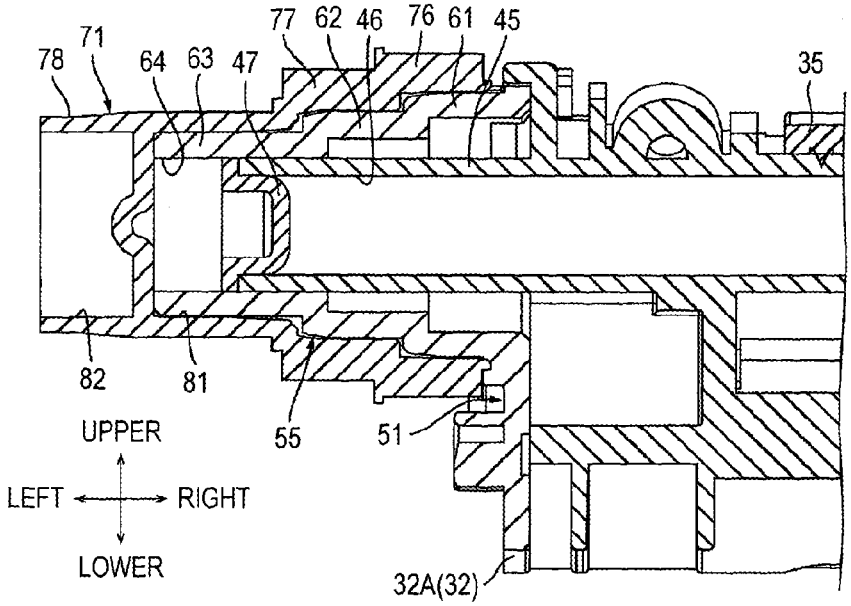
FIG. 5B is a cross-sectional view of the developing cartridge taken along line A-A in FIG. 5A.

As illustrated in FIGS. 4 and 5A, the gear train 52 includes a developing coupling 71 serving as an example of the driving force receiving member, a developing gear 72, a supply gear 73, an idle gear 74, and an agitator gear 75.

As illustrated in FIGS. 4 and 5B, the developing coupling 71 has a substantially cylindrical shape extending in the right-left direction and is rotatably supported by the coupling support shaft 55. The developing coupling 71 includes a first coupling gear portion 76 serving as an example of the gear portion, a second coupling gear portion 77, and a coupling portion 78 in an integrated manner.

The first coupling gear portion 76 is located at the right end portion of the developing coupling 71. The first coupling gear portion 76 has a substantially cylindrical shape extending in the right-left direction. The inner diameter of the first coupling gear portion 76 is slightly larger than the outer diameter of the first shaft portion 61 of the coupling support shaft 55. The first coupling gear portion 76 has gear teeth on the entire circumferential surface thereof.

The second coupling gear portion 77 has a substantially cylindrical shape extending toward the left side from the left end portion of the first coupling gear portion 76. The outer diameter of the second coupling gear portion 77 is smaller than the outer diameter of the first coupling gear portion 76. The inner diameter of the second coupling gear portion 77 is smaller than the inner diameter of the first coupling gear portion 76 and slightly larger than the outer diameter of the second shaft portion 62 of the coupling support shaft 55. The second coupling gear portion 77 has gear teeth on the entire circumferential surface thereof.

The coupling portion 78 has a substantially cylindrical columnar shape extending to the left side from the left end portion of the second coupling gear portion 77. The outer diameter of the coupling portion 78 is smaller than the outer diameter of the second coupling gear portion 77. The coupling portion 78 includes an inner concave portion 81, an outer concave portion 82, and a pair of protrusions 83.

The inner concave portion 81 is concave to the left side from the right end face of the coupling portion 78 and has a substantially circular shape in a side view. The diameter of the inner concave portion 81 is smaller than the inner diameter of the second coupling gear portion 77 and slightly larger than the outer diameter of the third shaft portion 63 of the coupling support shaft 55.

The outer concave portion 82 is concave to the right side from the left end face of the coupling portion 78 and has a substantially circular shape in a side view.

The protrusions 83 are located in the outer concave portion 82. The protrusions 83 are located to face each other in the radial direction of the outer concave portion 82. The protrusions 83 protrude inward in the radial direction to the center of the outer concave portion 82 from the inner circumferential surface of the outer concave portion 82.

The developing coupling 71 is rotatably supported by the support shaft unit 51 by receiving the first coupling gear portion 76 in the first shaft portion 61 of the coupling support shaft 55 so as to be relatively rotatable, receiving the second coupling gear portion 77 in the second shaft portion 62 of the coupling support shaft 55 so as to be relatively rotatable, and receiving the inner concave portion 81 of the coupling portion 78 in the third shaft portion 63 of the coupling support shaft 55 so as to be relatively rotatable. Accordingly, as illustrated in FIG. 5A, the developing coupling 71 can rotate around a rotation axis L4 extending in the right-left direction.

As illustrated in FIGS. 4 and 5A, the developing gear 72 has a substantially cylindrical shape extending in the right-left direction. The developing gear 72 is attached to the left end portion of the developing roller 2 so as not to be relatively rotatable. The developing gear 72 engages with the rear end portion of the first coupling gear portion 76 of the developing coupling 71.

The supply gear 73 has a substantially cylindrical shape extending in the right-left direction. The supply gear 73 is attached to the left end portion of the supply roller 3 so as not to be relatively rotatable. The supply gear 73 engages with the lower-rear end portion of the second coupling gear portion 77 of the developing coupling 71.

The idle gear 74 is located on the lower-front side of the developing coupling 71. The idle gear 74 has a substantially cylindrical shape extending in the right-left direction. As illustrated in FIG. 4, the idle gear 74 includes a large-diameter gear 85 and a small-diameter gear 86 in an integrated manner.

The large-diameter gear 85 is located in the left half of the idle gear 74. The large-diameter gear 85 has a substantially cylindrical shape extending in the right-left direction. The large-diameter gear 85 engages with the lower-front end portion of the second coupling gear portion 77 of the developing coupling 71.

The small-diameter gear 86 has a substantially cylindrical shape extending from the right end face of the large-diameter gear 85 to the right side. The outer diameter of the small-diameter gear 86 is smaller than the outer diameter of the large-diameter gear 85. The inner diameter of the small-diameter gear 86 is smaller than the inner diameter of the large-diameter gear 85 and is slightly larger than the diameter of the idle gear support shaft 56.

The idle gear 74 is rotatably supported by the support shaft unit 51 attached to the left side wall 32A by receiving the idle gear support shaft 56 in the small-diameter gear 86 so as to be relatively rotatable. Accordingly, the idle gear 74 can rotate around a rotation axis L5 extending in the right-left direction as illustrated in FIG. 5A.

As illustrated in FIGS. 4 and 5A, the agitator gear 75 is located on the upper-front side of the idle gear 74. The agitator gear 75 has a substantially cylindrical shape extending in the right-left direction. The agitator gear 75 includes a gear portion 88 and an engaging portion 89 in an integrated manner.

The gear portion 88 is located in the left half of the agitator gear 75. The gear portion 88 has a substantially cylindrical shape extending in the right-left direction. The gear portion 88 engages with the upper-front end portion of the small-diameter gear 86 of the idle gear 74.

The engaging portion 89 has a substantially cylindrical shape extending from the right end face of the gear portion 88 to the right side. The outer diameter of the engaging portion 89 is smaller than the outer diameter of the gear portion 88. The engaging portion 89 is attached to the left end face of the agitator 6 so as not to be relatively rotatable.

(2-2-3) Gear Cover

As illustrated in FIGS. 3 and 4, the gear cover 53 covers the gear train 52 from the left side. The gear cover 53 has a substantially box shape which is opened to the right side. The gear cover 53 includes a coupling exposing opening 91.

The coupling exposing opening 91 is located in the rear portion of the left wall of the gear cover 53. The coupling exposing opening 91 has a substantially circular shape in a side view and penetrates the left wall of the gear cover 53 in the right-left direction. The gear cover 53 is screwed to the left side wall 32A so as to expose the outer concave portion 82 of the developing coupling 71 from the coupling exposing opening 91 and to collectively cover the gear train 52.

4. Relative Arrangement of Filling Port

In a projection image of the right-left direction of the developing cartridge 1, the filling port 46 of the filling tube 45 overlaps the development chamber 7. Specifically, as illustrated in FIG. 1, the filling port 46 of the filling tube 45 overlaps an area above the supply roller 3 in the development chamber 7 when projected in the right-left direction. That is, the filling port 46 is located above the supply roller 3.

Figure 6A:
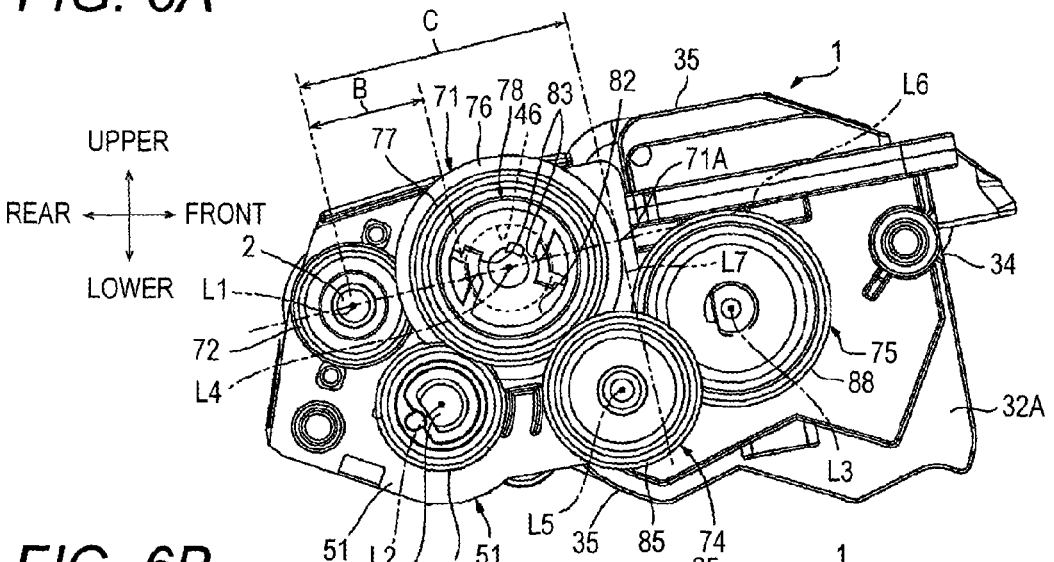
FIG. 6A is a side view illustrating the developing cartridge illustrated in FIG. 1 and illustrating a tangent line passing through an edge point of a developing coupling.

As illustrated in FIG. 6A, the filling port 46 overlaps the developing coupling 71 when projected in the right-left direction.

The filling port 46 is located at the developing roller 2 side than a tangent line L7 passing through an edge point 71A of the developing coupling 71. Specifically, the edge point 71A of the developing coupling 71 is an edge point of an addendum circle of the developing coupling 71 which is located in a straight line L6 orthogonal to both the rotation axis L1 of the developing roller 2 and the rotation axis L4 of the developing coupling 71 and is located on the opposite side of the developing roller 2 with respect to the rotation axis L4 of the developing coupling 71. In other words, the edge point 71A of the developing coupling 71 is an edge point located farthest from the developing roller 2 among the edge points of the addendum circle of the developing coupling 71 located on the straight line L6. The tangent line L7 is a tangent line to the edge point 71A of the developing coupling 71. The straight line L6 extends along a direction connecting the lower-rear side and the upper-front side. The tangent line L7 extends along a direction connecting the upper-rear side and the lower-front side. The filling port 46 is located on the rear side of the tangent line L7.

A distance B from the rotation axis L1 of the developing roller 2 to the filling port 46 is smaller than a distance C from the rotation axis L1 of the developing roller 2 to the edge point 71A of the developing coupling 71.

Figure 6B:
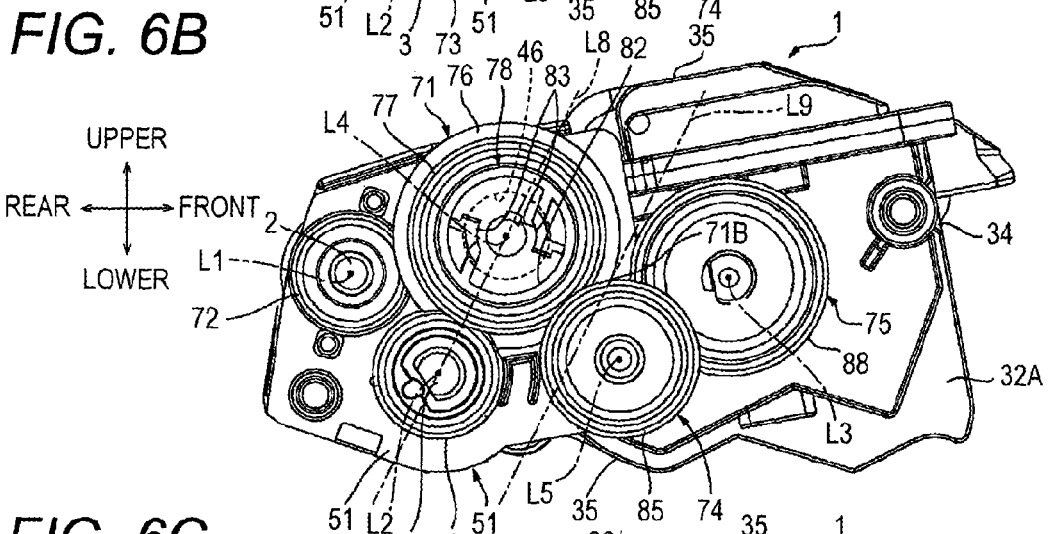
FIG. 6B is a side view illustrating the developing cartridge illustrated in FIG. 1 and illustrating a tangent line passing through a second edge point of the developing coupling.

As illustrated in FIG. 6B, the filling port 46 is located at the developing roller 2 side than a tangent line L9 passing through an edge point 71B of the developing coupling 71. Specifically, the edge point 71B of the developing coupling 71 is an edge point located farthest from the developing roller 2 among two edge points of the addendum circle of the developing coupling 71. Here, the two edge points are points at which straight lines, which are parallel to a straight line L8 orthogonal to both the rotation axis L2 of the supply roller 3 and the rotation axis L4 of the developing coupling 71, respectively serve as tangent lines of the developing coupling 71. The tangent line L9 is a tangent line to the edge point 71B of the developing coupling 71. The straight line L8 extends along the direction connecting the lower-rear side and the upper-front side. The tangent line L9 extends in parallel to the straight line L8 and specifically extends along the direction connecting the lower-rear side and the upper-front side. The filling port 46 is located on the rear side of the tangent line L9.

Figure 6C:
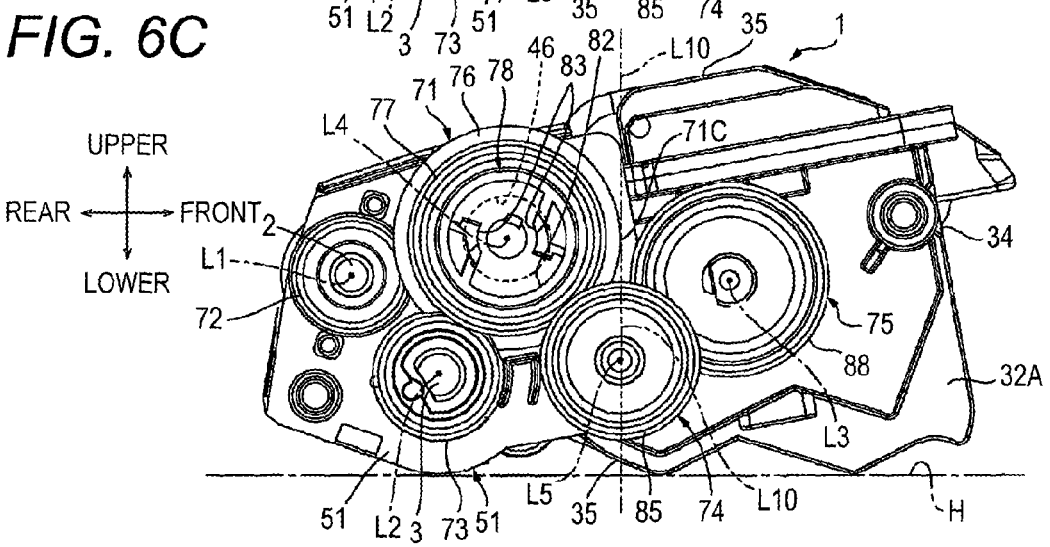
FIG. 6C is a side view illustrating the developing cartridge illustrated in FIG. 1 and illustrating a straight line passing through a third edge point of the developing coupling.

As illustrated in FIG. 6C, the filling port 46 is located at the developing roller 2 side than a tangent line L10 passing through an edge point 71C of the developing coupling 71. Specifically, the edge point 71C of the developing coupling 71 is an edge point which is located farthest from the developing coupling 71 among two edge points of the addendum circle of the developing coupling 71, when projected in the upper-lower direction. In other words, the edge point 71C is an edge point which is located farthest from the developing coupling 71 among two edge points of the addendum circle of the developing coupling 71, when projected in a vertical direction perpendicular to the horizontal plane H, and is a front edge point of the developing coupling 71. The tangent line L10 extends along the upper-lower direction, that is, the vertical direction. The filling port 46 is located on the rear side of the tangent line L10.

5. Filling of Toner

Figure 7A:
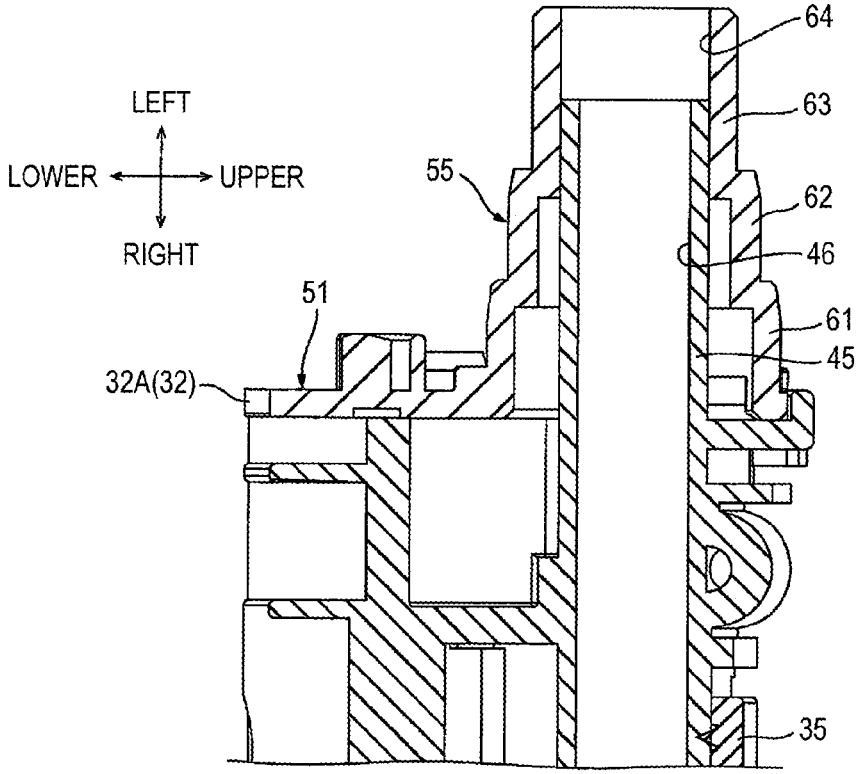
FIG. 7A is a cross-sectional view illustrating the left end portion of the developing cartridge illustrated in FIG. 1 and illustrating a state where the developing coupling and the gear cover are detached therefrom.
Figure 7B:
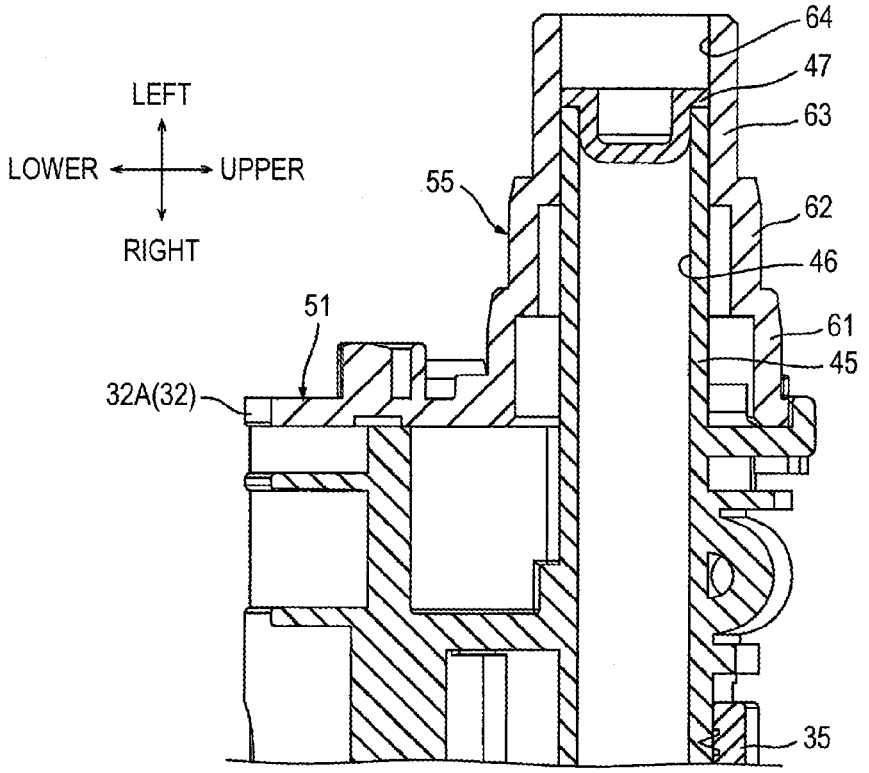
FIG. 7B is a cross-sectional view illustrating a state where a cap is attached to the left end portion of the developing cartridge illustrated in FIG. 7A.

When filling toner into the developing cartridge 1, as illustrated in FIGS. 7A and 7B, an operator locates the left side wall 32A of the developing cartridge 1 illustrated in FIG. 3 on the upside. In the following description, the directions are based on a state where the left side wall 32A of the developing cartridge 1 is located on the upside.

Specifically, as illustrated in FIG. 7A, the operator holds the developing cartridge 1 so as to locate the left side wall 32A on the upside in a state where the gear cover 53 and the developing coupling 71 of the developing cartridge 1 are detached therefrom.

At this time, the cap 47 is not attached to the filling port 46 of the filling tube 45, and the penetration hole 64 and the filling port 46 of the filling tube 45 communicate with each other.

In this state, the operator inputs toner to the lower side from the penetration hole 64.

Then, the toner moves downward in the third shaft portion 63 of the coupling support shaft 55 and then moves downward in the filling tube 45. The toner moving in the filling tube 45 filled in the development chamber 7 of the developing cartridge 1 as illustrated in FIG. 1. The toner filled in the development chamber 7 also fills the toner containing chamber 5 through the communication port 36.

When the operation of filling toner is completed, as illustrated in FIG. 7B, the operator attaches the cap 47 to the filling port 46 of the filling tube 45 to close the filling port 46 with the cap 47. Further, as illustrated in FIG. 5B, while fitting the developing coupling 71 to the coupling support shaft 55, as illustrated in FIGS. 3 and 4, the gear cover 53 is attached to the left side wall 32A so as to cover the gear train 52 with the gear cover 53.

At this time, as illustrated in FIG. 5B, the cap 47 is located between the filling port 46 of the filling tube 45 and the developing coupling 71.

6. Operation of Gear Train

In attaching the developing cartridge 1 to the body casing 12, the operator first attaches the developing cartridge 1 to the drum cartridge 21 to configure a process cartridge 13 as illustrated in FIG. 2. Then, the operator opens the top cover 18 and inserts the process cartridge 13 into the body casing 12 from the upside via the opening 17. Subsequently, the operator closes the top cover 18.

Then, as illustrated in FIG. 3, a body coupling 110 of the body casing 12 moves into the outer concave portion 82 of the coupling portion 78 so as not to be relatively rotatable and engages with the protrusions 83 by a known interlocking mechanism which is not illustrated. When the image forming operation is started, the body coupling 110 inputs a driving force to the coupling portion 78 of the developing coupling 71 as illustrated in FIG. 5A. Then, the developing coupling 71 rotates in the clockwise direction when viewed from the left side. At this time, the developing coupling 71 transmits the driving force to the developing gear 72, the supply gear 73, and the idle gear 74.

When the driving force is transmitted to the developing gear 72 and the supply gear 73, the developing roller 2 and the supply roller 3 rotate in the counterclockwise direction when viewed from the left side.

When the driving force is transmitted to the idle gear 74, the idle gear 74 rotates in the counterclockwise direction when viewed from the left side and transmits the driving force to the agitator gear 75 engaging with the small-diameter gear 86. Then, the agitator 6 rotates in the clockwise direction when viewed from the left side.

At this time, as described above, the development chamber 7 of the developing cartridge 1 is filled with toner. Accordingly, even when the image forming operation is performed just after the process cartridge 13 is attached to the body casing 12, the developing roller 2 sufficiently carries the toner.

7. Operational Advantages (1) According to the developing cartridge 1, as illustrated in FIG. 6A, the filling port 46 overlaps the developing coupling 71 when projected in the right-left direction. Further, the filling port 46 is located at the developing roller 2 side than the tangent line L7 passing through the edge point 71A of the developing coupling 71. That is, the filling port 46 is located on the rear side of the tangent line L7. Further, the distance B from the rotation axis L1 of the developing roller 2 to the filling port 46 is smaller than the distance C from the rotation axis L1 of the developing roller 2 to the edge point 71A of the developing coupling 71.

Accordingly, the filling port 46 can be located close to the developing roller 2.

As a result, when toner is filled into the developing frame 31 through the filling port 46, it is possible to fill the vicinity of the developing roller 2 with the toner.

Therefore, even just after an unused developing cartridge 1 is attached to the printer 11, it is possible to cause the developing roller 2 to smoothly carry toner. Accordingly, even just after an unused developing cartridge 1 is attached to the printer 11, it is possible to smoothly form an image.

Further, in the toner filling operation, when filling toner into the developing frame 31 through the filling port 46, the toner may be attached to the vicinity of the filling port 46.

However, according to the above-mentioned configuration, even when the vicinity of the filling port 46 becomes dirty with the toner, it is possible to cover the dirt with the developing coupling 71. Accordingly, it is possible to make the dirt around the filling port 46 inconspicuous.

(2) According to the developing cartridge 1, as illustrated in FIG. 1, the filling port 46 is located above the supply roller 3.

Accordingly, when filling toner into the developing frame 31 through the filling port 46, it is possible to fill the vicinity of the supply roller 3 with the toner.

As a result, even just after an unused developing cartridge 1 is attached to the printer 11, it is possible to smoothly supply toner from the supply roller 3 to the developing roller 2. Therefore, even just after an unused developing cartridge 1 is attached to the printer 11, it is possible to smoothly form an image.

(3) According to the developing cartridge 1, as illustrated in FIG. 4, the coupling support shaft 55 has the penetration hole 64 communicating with the filling port 46.

Accordingly, it is possible to fill toner into the filling port 46 using the penetration hole 64 of the coupling support shaft 55.

As a result, it is possible to easily fill the developing frame 31 with toner.

(4) According to the developing cartridge 1, as illustrated in FIG. 5B, the cap 47 is located between the filling port 46 and the developing coupling 71.

Accordingly, it is possible to cover the cap 47 with the developing coupling 71.

As a result, it is possible to reliably close the filling port 46 with the cap 47.

(5) According to the developing cartridge 1, as illustrated in FIG. 6A, the filling port 46 is located on the rear side of the tangent line L7. The distance B from the rotation axis L1 of the developing roller 2 to the filling port 46 is smaller than the distance C from the rotation axis L1 of the developing roller 2 to the edge point 71A of the developing coupling 71. The developing gear 72 and the supply gear 73 engage with the developing coupling 71.

Accordingly, it is possible to dispose the filling port 46, the developing gear 72, and the supply gear 73 in a limited space in the developing cartridge 1.

As a result, it is possible to achieve a decrease in size of the developing cartridge 1.

(6) According to the developing cartridge 1, as illustrated in FIG. 6B, the filling port 46 is located to be at the developing roller 2 side than the tangent line L9 passing through the edge point 71B of the developing coupling 71. That is, the filling port 46 is located on the rear side of the tangent line L9.

Accordingly, it is possible to locate the filling port 46 to be closer to the developing roller 2 than the tangent line L9.

As a result, when toner is filled into the developing frame 31 through the filling port 46, it is possible to fill the vicinity of the developing roller 2 with the toner.

Accordingly, even just after an unused developing cartridge 1 is attached to the printer 11, it is possible to cause the developing roller 2 to smoothly carry toner. Therefore, even just after an unused developing cartridge 1 is attached to the printer 11, it is possible to smoothly form an image.

(7) According to the developing cartridge 1, as illustrated in FIG. 6C, the filling port 46 is located to be at the developing roller 2 side than the tangent line L10 passing through the edge point 71C of the developing coupling 71. That is, the filling port 46 is located on the rear side of the tangent line L10.

Accordingly, it is possible to locate the filling port 46 to be closer to the developing roller 2 than the tangent line L10.

As a result, when toner is filled into the developing frame 31 through the filling port 46, it is possible to fill the vicinity of the developing roller 2 with the toner.

Accordingly, even just after an unused developing cartridge 1 is attached to the printer 11, it is possible to cause the developing roller 2 to smoothly carry toner. Therefore, even just after an unused developing cartridge 1 is attached to the printer 11, it is possible to smoothly form an image.

8. Modification Example

Modification Examples of the developing cartridge 1 will be described below with reference to FIGS. 8A to 10B. In the following modification examples, the same elements as in the first embodiment will be referenced by the same reference signs and description thereof will not be repeated.

(1) Second Embodiment

(1-1) Details of Developing Cartridge According to Second Embodiment

In the first embodiment, the developing cartridge 1 includes the toner containing chamber 5 and the development chamber 7 in the developing frame 31.

Figure 8A:
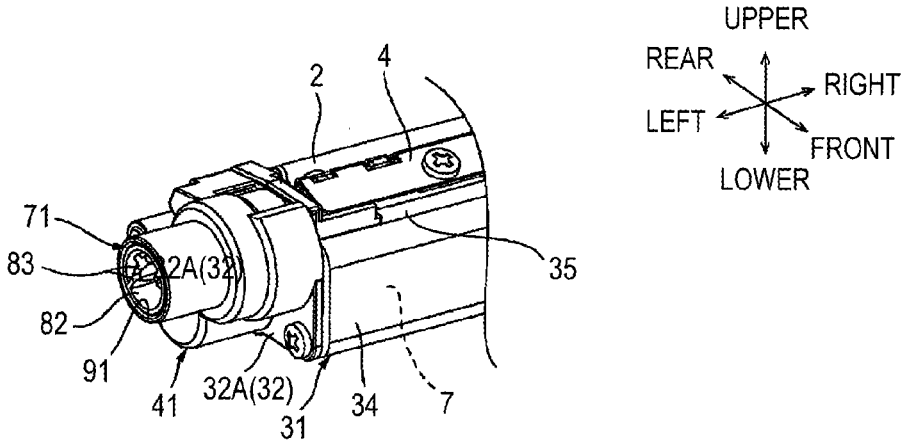
FIG. 8A is a perspective view illustrating a developing cartridge according to a second embodiment of the invention and illustrating a left end portion of the developing cartridge when viewed from the upper-left side.
Figure 8B:
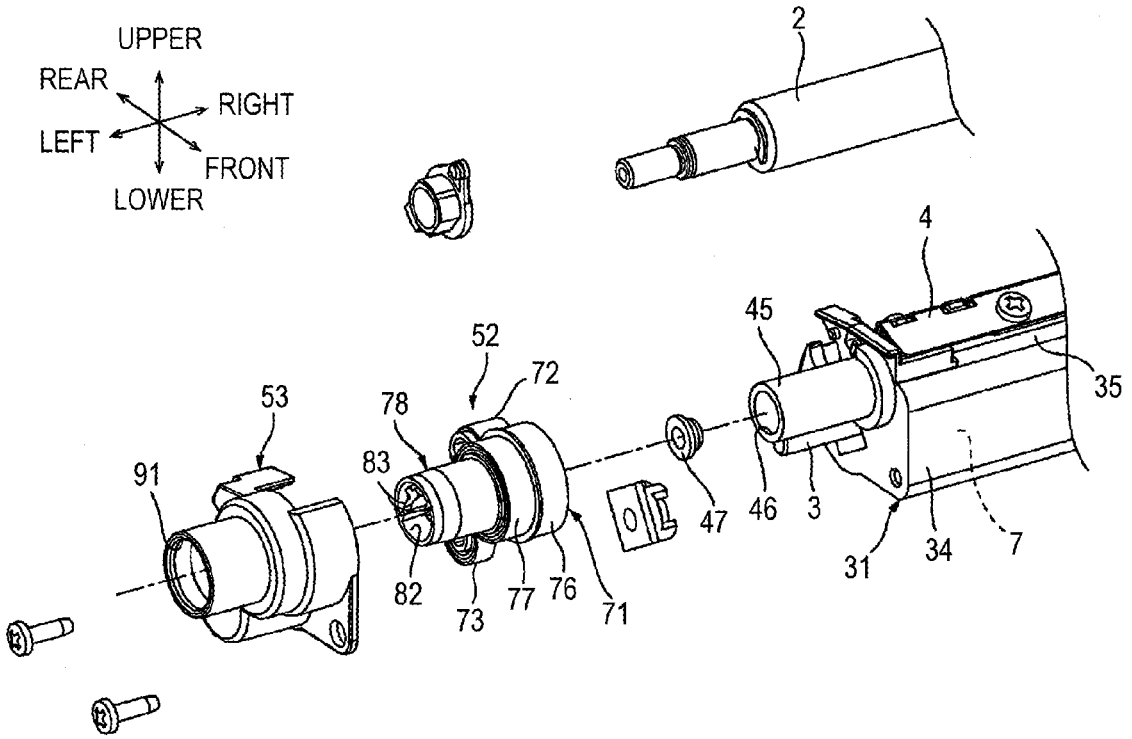
FIG. 8B is an exploded perspective view illustrating the left end portion of the developing cartridge illustrated in FIG. 8A when viewed from the upper-left side.

On the other hand, in a developing cartridge 1 according to a second embodiment, as illustrated in FIGS. 8A and 8B, the development chamber 7 also functions as the toner containing chamber 5 in the developing frame 31.

That is, in the second embodiment, the developing cartridge 1 does not include the agitator 6. Further, the front wall 34 is located on the front side of the developing coupling 71 in the front-rear direction.

In the developing cartridge 1, the development chamber 7 is defined by the front wall 34, a pair of side walls 32, the bottom wall 33, and the top wall 35.

In the toner filling operation, when toner is filled through the filling port 46, the development chamber 7 is filled with the toner.

(1-2) Operational Advantages of Second Embodiment

According to the developing cartridge 1 of the second embodiment, as illustrated in FIGS. 8A and 8B, the development chamber 7 also functions as the toner containing chamber 5.

Accordingly, in comparison with a case where the toner containing chamber 5 is separately provided, it is possible to achieve a decrease in size of the developing cartridge 1.

According to the developing cartridge 1 of the second embodiment, it is possible to obtain the same operational advantages as in the first embodiment.

(2) Third Embodiment

(2-1) Details of Developing Cartridge According to Third Embodiment

In the first embodiment, the filling port 46 overlaps the developing coupling 71 when projected in the right-left direction.

Figure 10A:
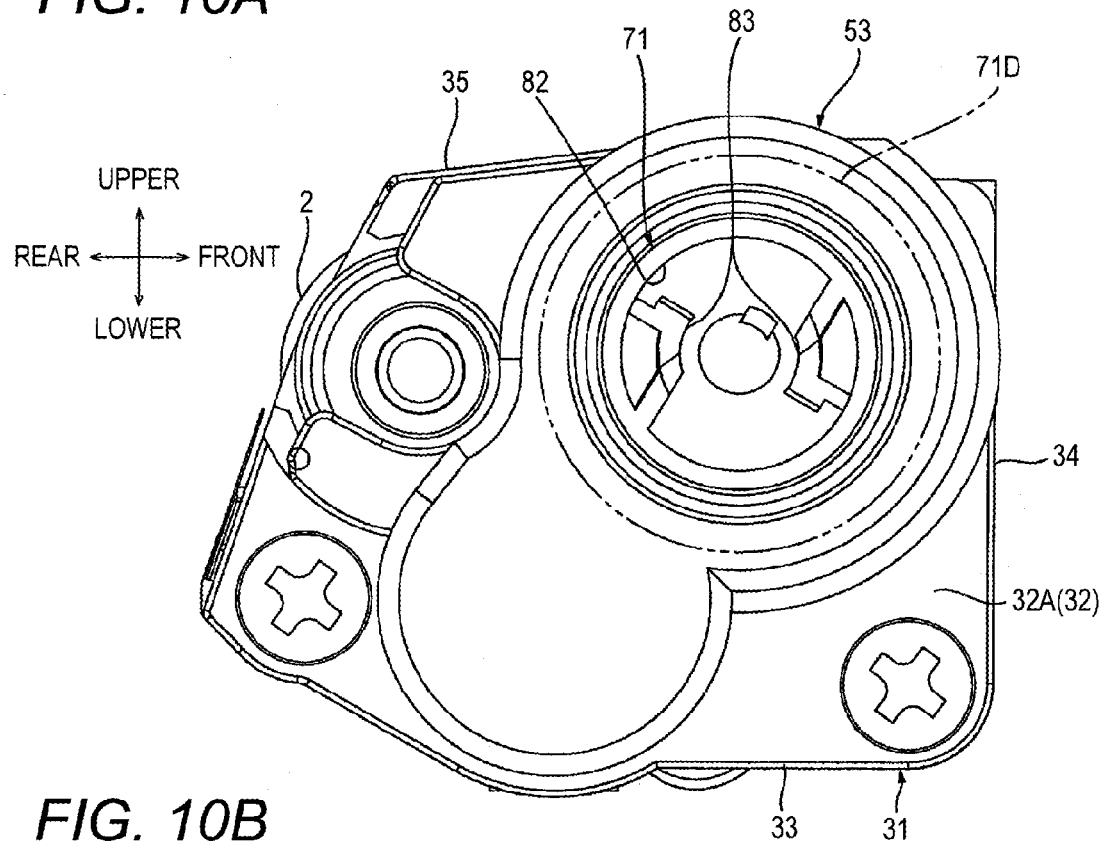
FIG. 10A is a side view illustrating the developing cartridge illustrated in FIG. 9.
Figure 10B:
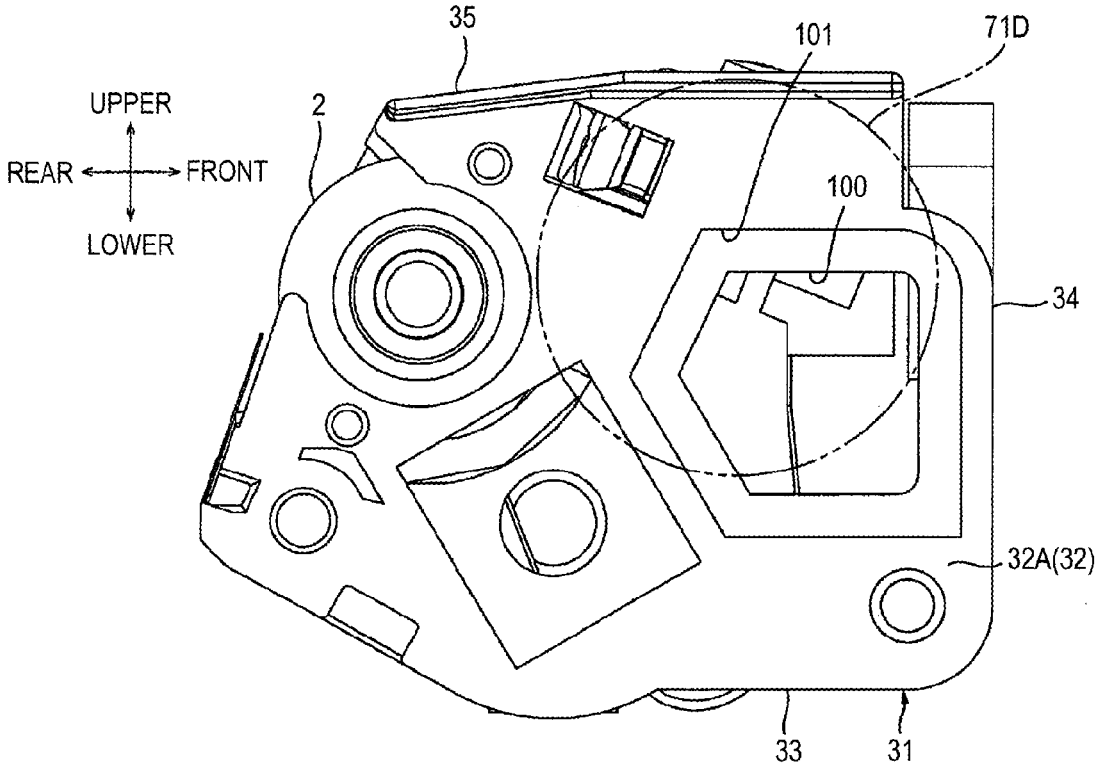
FIG. 10B is a side view illustrating the developing cartridge illustrated in FIG. 9 and illustrating a state where a support shaft unit, a gear cover, and a developing coupling are detached therefrom.

On the other hand, in a third embodiment, as illustrated in FIG. 10B, a part of a filling port 100 is located outside a projection area of the developing coupling 71 when projected in the right-left direction.

Figure 9:
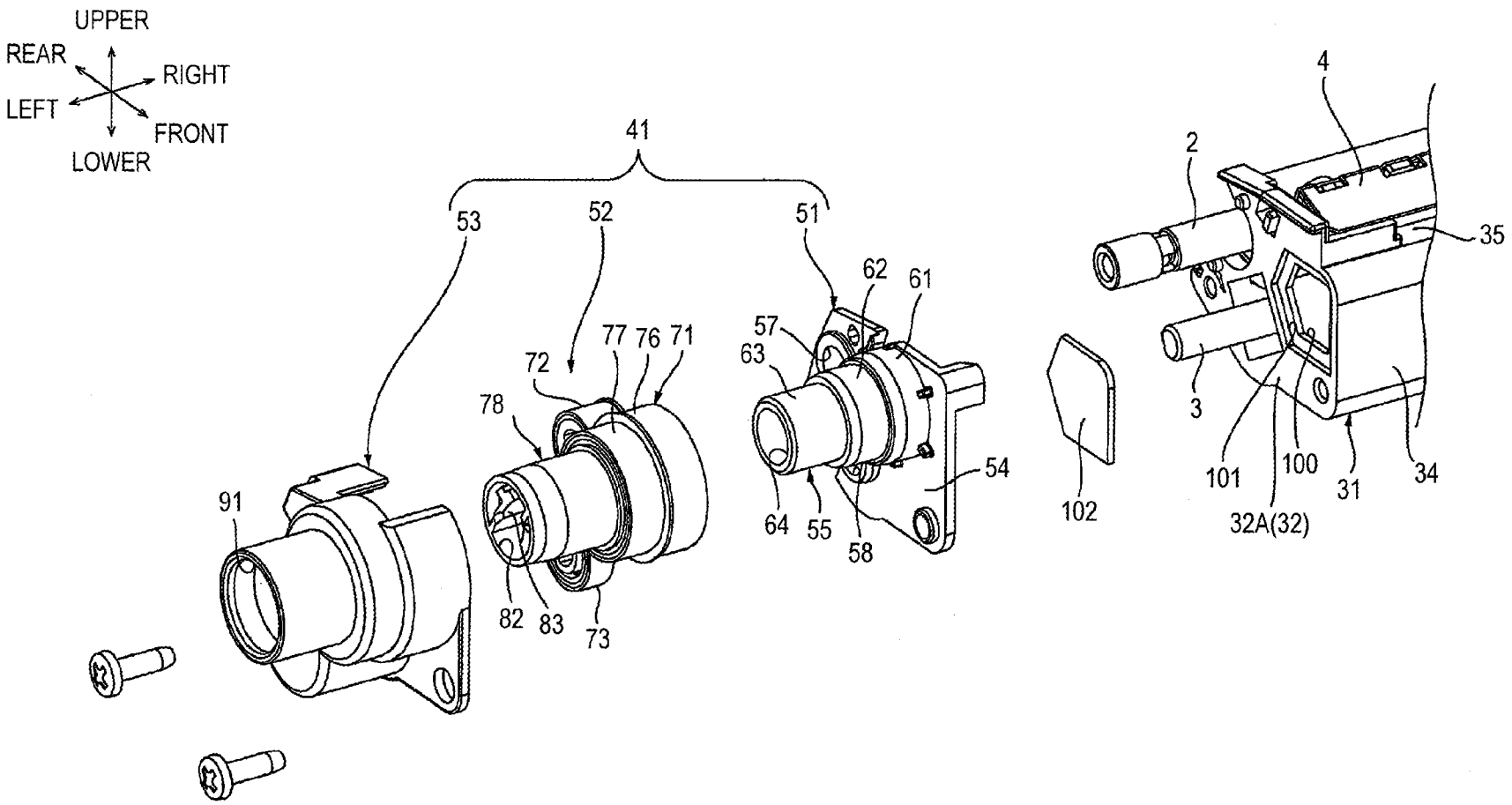
FIG. 9 is a perspective view illustrating a developing cartridge according to a third embodiment of the invention and is an exploded perspective view illustrating a left end portion of the developing cartridge when viewed from the upper-left side.

That is, in the third embodiment, similarly to the second embodiment, the development chamber 7 also functions as the toner containing chamber 5 in the developing frame 31. Further, as illustrated in FIG. 9, the developing cartridge 1 includes the filling port 100 instead of the filling port 46.

The filling port 100 is located in the front portion of the left side wall 32A. The filling port 100 has a substantially polygonal shape in a side view and penetrates the left side wall 32A in the right-left direction.

The left side wall 32A includes a stepped portion 101. The stepped portion 101 is located in the left side wall 32A so as to surround the filling port 100 and has a frame shape in a side view. The stepped portion 101 is depressed to the right side from the left surface of the left side wall 32A. A cap 102 is attached to the stepped portion 101.

The cap 102 has a substantially polygonal shape in a side view and the outline thereof has substantially the same shape as the outline of the stepped portion 101. Further, the cap 102 is attached to the stepped portion 101 so as to be flush with the left surface of the left side wall 32A.

In filling toner into the developing frame 31, an operator locates the left side wall 32A on the upside and holds the developing cartridge 1 in a state where the support shaft unit 51, the gear train 52, the gear cover 53, and the cap 102 are detached from the developing frame 31.

The operator fills toner into the developing frame 31 through the filling port 100. When the toner filling operation is completed, the operator attaches the cap 102 to the stepped portion 101 and additionally attaches the support shaft unit 51, the gear train 52, and the gear cover 53 to the left side wall 32A.

As illustrated in FIGS. 10A and 10B, an outer circumferential edge 71D of the developing coupling 71 is located in the upper-front portion of the developing cartridge 1 when projected the right-left direction. The outer circumferential edge 71D of the developing coupling 71 is an example of the projection area.

As illustrated in FIG. 10B, the lower-front portion of the filling port 100 is located outside the outer circumferential edge 71D of the developing coupling 71 when projected in the right-left direction.

(2-2) Operational Advantages of Third Embodiment

According to a developing cartridge 1 of a third embodiment, as illustrated in FIG. 10B, it is possible to form the filling port 100 to be large such that the lower-front portion thereof is located outside the outer circumferential edge 71D of the developing coupling 71.

As a result, it is possible to easily fill the developing frame 31 with toner through the filling port 100.

According to the developing cartridge 1 of the third embodiment, it is possible to obtain the same operational advantages as in the first embodiment.

(3) Other Modification Example

In the above-mentioned embodiments, toner is filled into the filling port 46 through the penetration hole 64 of the coupling support shaft 55 in the toner filling operation. However, toner may be filled from the filling port 46 in a state where the support shaft unit 51 is detached from the developing cartridge 1. In this case, after the toner is completely filled, the cap 47 is attached to the filling port 46 and then the support shaft unit 51 is attached to the left side wall 32A of the developing cartridge 1.

In the above-mentioned embodiment, toner is carried by the developing roller 2. However, for example, a magnetic roller or a brush roller may be used instead of the developing roller 2.

In the above-mentioned embodiment, the supply roller 3 supplies toner to the developing roller 2. However, a brush-shaped roller may be used instead of the supply roller 3.

In the above-mentioned embodiment, the developing coupling 71 is described as an example of the driving force receiving member. However, a gear may be used as the driving force receiving member instead of the developing coupling 71. A driving force may be applied to the developing cartridge 1 from the body of the printer 11 using the gear.

In the above-mentioned embodiment, a tandem color printer is described as the printer 11. However, a four-cycle electrophotographic printer or a monochrome printer may be used instead of the printer 11.

The invention provides illustrative, non-limiting aspects as follows:

According to an aspect of the invention, there is provided a developing cartridge including: a housing; a developing roller rotatable around a rotation axis extending in a first direction; a developing gear supported by an end portion of the developing roller; and a driving force receiving member rotatable around a rotation axis extending in the first direction by receiving a driving force from an image forming apparatus body and including a gear portion engaging with the developing gear, wherein the housing has an opening for filling the housing with developer, and wherein at least a part of the driving force receiving member overlaps the opening when viewed in the first direction.

According to this configuration, at least a part of the driving force receiving member overlaps the opening when viewed in the first direction. Further, the gear portion of the driving force receiving member engages with the developing gear fixed to an end portion of the developing roller.

Accordingly, the opening can be located close to the developing roller.

Further, when developer is filled into the housing through the opening, it is possible to fill the vicinity of the developing roller with the developer.

As a result, even just after an unused developing cartridge is attached to an image forming apparatus, it is possible to cause the developing roller to smoothly carry developer.

Accordingly, even just after an unused developing cartridge is attached to an image forming apparatus, it is possible to smoothly form an image.

Further, even when the vicinity of the opening becomes dirty by toner, it is possible to cover the dirt with the driving force receiving member.

Accordingly, it is possible to make the dirt around the opening inconspicuous.

The above developing cartridge may further include a supply roller located inside the housing on one side in a third direction, which is perpendicular to both the first direction and a second direction perpendicular to the first direction, and configured to supply developer to the developing roller. The opening may be located on another side in the third direction with respect to the supply roller.

According to this configuration, when filling developer into the housing through the opening, it is possible to fill the vicinity of the supply roller with the developer.

Accordingly, even just after an unused developing cartridge is attached to an image forming apparatus, it is possible to smoothly supply developer from the supply roller to the developing roller.

As a result, even just after the unused developing cartridge is attached to the image forming apparatus, it is possible to smoothly form an image.

In the above developing cartridge, the housing may include a first side wall and a second side wall which are located with a gap therebetween. The first side wall may have the opening.

In the above developing cartridge, the developing roller may be located between the first side wall and the second side wall.

The above developing cartridge may further include a support shaft located on an opposite side of the second side wall with respect to the first side wall and configured to rotatably support the driving force receiving member. The support shaft may have a penetration hole communicating with the opening.

According to this configuration, it is possible to fill developer into the opening using the penetration hole of the support shaft.

Accordingly, it is possible to easily fill the housing with developer.

The above developing cartridge may further include a support shaft rotatably supporting the driving force receiving member and having a cylindrical shape. The opening may be located in the support shaft.

In the above developing cartridge, the support shaft may be extending in the first direction.

The above developing cartridge may further include a closing member closing the opening. The closing member may be located between the opening and the driving force receiving member.

According to this configuration, it is possible to cover the closing member with the driving force receiving member.

Accordingly, it is possible to reliably close the opening with the closing member.

In the above developing cartridge, when projected in the first direction, at least a part of the opening may be located outside a projection area of the driving force receiving member.

According to this configuration, it is possible to form the opening to be large so as to be located outside the projection area of the driving force receiving member.

Accordingly, it is possible to easily fill the housing with developer through the opening.

The above developing cartridge may further include a supply roller configured to supply developer to the developing roller, and a supply gear configured to engage with the gear portion and transmit a driving force from the driving force receiving member to the supply roller.

According to this configuration, the supply gear engages with the gear portion of the driving force receiving member. Further, the developing gear also engages with the gear portion of the driving force receiving member. Further, at least a part of the driving force receiving member overlaps the opening when viewed in the first direction.

Accordingly, it is possible to dispose the opening, the supply gear, and the developing gear in a limited space in the developing cartridge.

As a result, it is possible to achieve a decrease in size of the developing cartridge.

According to another aspect of the invention, there is provided a developing cartridge including: a housing configured to contain developer therein and including a first side wall and a second side wall which are located with a gap therebetween;

a developing roller located between the first side wall and the second side wall and configured to rotate around a rotation axis extending in a first direction; a supply roller located between the first side wall and the second side wall and configured to supply developer to the developing roller by rotating around a rotation axis extending in the first direction; and a driving force receiving member located on an opposite side of the second side wall with respect to the first side wall, configured to rotate around a rotation axis extending in the first direction, and configured to rotate the developing roller and the supply roller by receiving a driving force from an image forming apparatus body, wherein the first side wall has an opening for filling the housing with developer, and wherein, when viewed in the first direction, at least a part of the opening is located at the developing roller side than a tangent line passing through one edge point among two edge points of the driving force receiving member, the two edge points being edge points at which straight lines, which are parallel to a straight line orthogonal to both the rotation axis of the supply roller and the rotation axis of the driving force receiving member, respectively serve as tangent lines of the driving force receiving member, and the one edge point being located farthest from the developing roller among the two edge points.

According to this configuration, the opening can be located closer to the developing roller than a tangent line passing through the one edge point among the two edge points of the driving force receiving member, the two edge points being edge points at which straight lines, which are parallel to a straight line orthogonal to both the rotation axis of the supply roller and the rotation axis of the driving force receiving member, respectively serve as tangent lines of the driving force receiving member, and the one edge point being located farthest from the developing roller among the two edge points.

Accordingly, when developer is filled into the housing through the opening, it is possible to fill the vicinity of the developing roller with the developer.

As a result, even just after an unused developing cartridge is attached to an image forming apparatus, it is possible to cause the developing roller to smoothly carry the developer.

Accordingly, even just after the unused developing cartridge is attached to the image forming apparatus, it is possible to smoothly form an image.

In the above developing cartridge, the supply roller may be located inside the housing on one side in a third direction, which is perpendicular to both the first direction and a second direction perpendicular to the first direction. The opening may be located on another side in the third direction with respect to the supply roller.

The above developing cartridge may further include a support shaft located on an opposite side of the second side wall with respect to the first side wall and configured to rotatably support the driving force receiving member. The support shaft may have a penetration hole communicating with the opening.

The above developing cartridge may further include a closing member closing the opening. The closing member may be located between the opening and the driving force receiving member.

In the above developing cartridge, when projected in the first direction, at least a part of the opening is located outside a projection area of the driving force receiving member.

The above developing cartridge may further include a developing gear supported by an end portion of the developing roller; a gear portion engaging with the developing gear; and a supply gear configured to engage with the gear portion and transmit a driving force from the driving force receiving member to the supply roller. The driving force receiving member may include the gear portion.

According to another aspect of the invention, there is provided a developing cartridge including: a housing including, a first side wall and a second side wall which are located with a gap therebetween, a developer containing chamber configured to contain developer therein, and a development chamber communicating with the developer containing chamber and accommodating therein a developing roller which is configured to rotate around a rotation axis extending in a first direction in which the first side wall and the second side wall face each other; and a driving force receiving member located on an opposite side of the second side wall with respect to the first side wall, configured to rotate around a rotation axis extending in the first direction, and configured to rotate the developing roller by receiving a driving force from an image forming apparatus body, wherein the first side wall has an opening for filling the housing with developer, and wherein at least a part of the opening is located at the developing roller side than a straight line extending along a third direction and passing through one edge point among two edge points of the driving force receiving member, the developer containing chamber and the development chamber being arranged in a second direction, the two edge points being edge points of the driving force receiving member in the second direction when the driving force receiving member is projected in the third direction perpendicular to both the first direction and the second direction, and the one edge point being located farthest from the developing roller among the two edge points.

According to this configuration, the opening can be located closer to the developing roller than a straight line extending along the third direction and passing through the one edge point among the two edge points of the driving force receiving member, the two edge points being edge points of the driving force receiving member in the second direction when the driving force member is projected in the third direction, and the one edge point being located farthest from the developing roller among the two edge points.

Accordingly, when developer is filled into the housing through the opening, it is possible to fill the vicinity of the developing roller with the developer.

As a result, even just after an unused developing cartridge is attached to an image forming apparatus, it is possible to cause the developing roller to smoothly carry developer.

Accordingly, even just after the unused developing cartridge is attached to the image forming apparatus, it is possible to smoothly form an image.

According to the developing cartridge of an aspect of the invention, even just after an unused developing cartridge is attached to an image forming apparatus, it is possible to smoothly form an image.

What is claimed is:

1. A developing cartridge comprising:

a housing;

a developing roller rotatable around a rotation axis extending in a first direction;

a developing gear supported by an end portion of the developing roller;

a driving force receiving member rotatable around a rotation axis extending in the first direction by receiving a driving force from an image forming apparatus body and including a gear portion engaging with the developing gear; and a supply roller located inside the housing on one side in a third direction, which is perpendicular to both the first direction and a second direction perpendicular to the first direction, and configured to supply developer to the developing roller, wherein the housing has an opening for filling the housing with developer, wherein at least a part of the driving force receiving member overlaps the opening when viewed in the first direction, wherein the opening is located on another side in the third direction with respect to the supply roller.

2. The developing cartridge according to claim 1, wherein the housing includes a first side wall and a second side wall which are located with a gap therebetween, and wherein the first side wall has the opening.

3. The developing cartridge according to claim 2, wherein the developing roller is located between the first side wall and the second side wall.

4. The developing cartridge according to claim 2, further comprising a support shaft located on an opposite side of the first side wall than the second side wall and configured to rotatably support the driving force receiving member, wherein the support shaft has a penetration hole communicating with the opening.

5. The developing cartridge according to claim 2, further comprising a support shaft rotatably supporting the driving force receiving member and having a cylindrical shape, wherein the opening is located in the support shaft.

6. The developing cartridge according to claim 5, wherein the support shaft is extending in the first direction.

7. The developing cartridge according to claim 2, further comprising a closing member closing the opening, wherein the closing member is located between the opening and the driving force receiving member.

8. The developing cartridge according to claim 1, wherein, when projected in the first direction, at least a part of the opening is located outside a projection area of the driving force receiving member.

9. The developing cartridge according to claim 1, further comprising:

a supply roller configured to supply developer to the developing roller; and a supply gear configured to engage with the gear portion and transmit a driving force from the driving force receiving member to the supply roller.

10. A developing cartridge comprising:

a housing configured to contain developer therein and including a first side wall and a second side wall which are located with a gap therebetween;

a developing roller located between the first side wall and the second side wall and configured to rotate around a rotation axis extending in a first direction;

a supply roller located between the first side wall and the second side wall and configured to supply developer to the developing roller by rotating around a rotation axis extending in the first direction; and a driving force receiving member located on an opposite side of the first side wall than the second side wall, configured to rotate around a rotation axis extending in the first direction, and configured to rotate the developing roller and the supply roller by receiving a driving force from an image forming apparatus body, wherein the first side wall has an opening for filling the housing with developer, and wherein, when viewed in the first direction, at least a part of the opening is located at the developing roller side of the driving force receiving member rather than at a side of a tangent line passing through one edge point among two edge points of the driving force receiving member, the two edge points being edge points at which straight lines, which are parallel to a straight line orthogonal to both the rotation axis of the supply roller and the rotation axis of the driving force receiving member, respectively serve as tangent lines of the driving force receiving member, and the one edge point being located farthest from the developing roller among the two edge points.

11. The developing cartridge according to claim 10, wherein the supply roller is located inside the housing on one side in a third direction, which is perpendicular to both the first direction and a second direction perpendicular to the first direction, wherein the opening is located on another side in the third direction with respect to the supply roller.

12. The developing cartridge according to claim 10, further comprising a support shaft located on an opposite side of the second side wall with respect to the first side wall and configured to rotatably support the driving force receiving member, wherein the support shaft has a penetration hole communicating with the opening.

13. The developing cartridge according to claim 10, further comprising a closing member closing the opening, wherein the closing member is located between the opening and the driving force receiving member.

14. The developing cartridge according to claim 10, wherein, when projected in the first direction, at least a part of the opening is located outside a projection area of the driving force receiving member.

15. The developing cartridge according to claim 10, further comprising:

a developing gear supported by an end portion of the developing roller;

a gear portion engaging with the developing gear; and a supply gear configured to engage with the gear portion and transmit a driving force from the driving force receiving member to the supply roller, wherein the driving force receiving member includes the gear portion.

16. A developing cartridge comprising:

a housing including, a first side wall and a second side wall which are located with a gap therebetween, a developer containing chamber configured to contain developer therein, and a development chamber communicating with the developer containing chamber and accommodating therein a developing roller which is configured to rotate around a rotation axis extending in a first direction in which the first side wall and the second side wall face each other; and a driving force receiving member located on an opposite side of the first side wall than the second side wall, configured to rotate around a rotation axis extending in the first direction, and configured to rotate the developing roller by receiving a driving force from an image forming apparatus body, wherein the first side wall has an opening for filling the housing with developer, and wherein at least a part of the opening is located at the developing roller side of the driving force receiving member rather than at a side of a straight line extending along a third direction and passing through one edge point among two edge points of the driving force receiving member, the developer containing chamber and the development chamber being arranged in a second direction, the two edge points being edge points of the driving force receiving member in the second direction when the driving force receiving member is projected in the third direction perpendicular to both the first direction and the second direction, and the one edge point being located farthest from the developing roller among the two edge points.

* * * * *